US006964382B2

(12) United States Patent
Alexander et al.

(10) Patent No.: US 6,964,382 B2
(45) Date of Patent: Nov. 15, 2005

(54) GRIP COVER FOR COATING DISPENSING DEVICE HAND GRIP

(75) Inventors: Kevin L. Alexander, Brownsburg, IN (US); Harold T. Allen, Indianapolis, IN (US); Michael C. Rodgers, Montpelier, OH (US); Dennis P. Stephens, Holland, OH (US)

(73) Assignee: Illinois Tool Works Inc., Glenview, IL (US)

( * ) Notice: Subject to any disclaimer, the term of this patent is extended or adjusted under 35 U.S.C. 154(b) by 173 days.

(21) Appl. No.: 10/619,282

(22) Filed: Jul. 15, 2003

(65) Prior Publication Data

US 2004/0050867 A1 Mar. 18, 2004

Related U.S. Application Data

(60) Provisional application No. 60/407,342, filed on Aug. 30, 2002.

(51) Int. Cl.[7] ..... B05B 7/02

(52) U.S. Cl. ..... 239/526; 239/530; 239/525; 239/DIG. 19; 239/527; 16/101; 16/421; 16/431

(58) Field of Search ..... 239/526, 527, 239/530, DIG. 19; 16/101, 421, 431

(56) References Cited

U.S. PATENT DOCUMENTS

| | | | | |
|---|---|---|---|---|
| 3,169,882 | A * | 2/1965 | Kock et al | 427/475 |
| 4,002,777 | A | 1/1977 | Juvinall et al. | |
| 4,285,446 | A | 8/1981 | Rapp et al. | |
| 4,915,304 | A * | 4/1990 | Campani | 239/473 |
| 4,936,036 | A * | 6/1990 | Sniezak et al. | 42/71.02 |
| 5,332,156 | A * | 7/1994 | Wheeler | 239/288 |
| 5,353,474 | A * | 10/1994 | Good et al. | 16/421 |
| 5,640,741 | A | 6/1997 | Yano | |
| 5,774,571 | A * | 6/1998 | Marshall | 382/119 |
| 6,161,256 | A * | 12/2000 | Quiring et al. | 16/431 |
| 6,568,483 | B2 * | 5/2003 | McCallops et al. | 173/169 |
| 6,796,389 | B2 * | 9/2004 | Pusateri et al. | 173/170 |

FOREIGN PATENT DOCUMENTS

| | | |
|---|---|---|
| DE | 200 12 540 | 10/2000 |
| DE | 201 08 961 | 8/2001 |
| DE | 201 10 486 | 9/2001 |

OTHER PUBLICATIONS

"REA III" Ransburg Electrostatic Systems Sales Brochure.
"REA 4" Ransburg Electrostatic Systems Sales Brochure.
"REA 70" Ransburg Electrostaic Systems Sales Brochure.
"REA 90" Ransburg Electrostaic Systems Sales Brochure.
"R-E-M Air Assisted Airless" Ransburg Electrostaic Systems Sales Brochure.
"M 90" Ransburg Electrostaic Systems Sales Brochure.

* cited by examiner

*Primary Examiner*—David A. Scherbel
*Assistant Examiner*—James S. Hogan
(74) *Attorney, Agent, or Firm*—Lisa M. Soltis; Mark W. Croll; Richard D. Conard

(57) ABSTRACT

A grip cover is provided for fitting over the hand grip of a coating dispensing device for dispensing coating material. The grip cover includes material for cushioning a hand of an operator using the coating dispensing device.

17 Claims, 9 Drawing Sheets

GRIP COVER FOR COATING DISPENSING DEVICE HAND GRIP

CROSS REFERENCE TO RELATED APPLICATIONS

This application claims priority under 35 U.S.C. 119(e) to U.S. Provisional Application Ser. No. 60/407,342, filed Aug. 30, 2002, which is expressly incorporated by reference herein.

FIELD OF THE INVENTION

This invention relates to atomizing and dispensing devices, and particularly to hand-held devices. It is disclosed in the context of devices for the dispensing of coating materials and the like, but is believed to have other applications as well.

BACKGROUND OF THE INVENTION

Handheld coating material dispensing devices of various types are well-known. There are, for example, the guns illustrated and described in U.S. Pat. Nos. 3,169,882; 4,002,777; and, 4,285,446. There are also the Ransburg model REA 3, REA 4, REA 70, REA 90, REM and M-90 guns, all available from ITW Ransburg, 320 Phillips Avenue, Toledo, Ohio, 43612-1493. No representation is intended by this listing that a thorough search of all material prior art has been conducted, or that no better art than that listed is available. Nor should any such representation be inferred.

The terms "front," "rear," "top," "bottom," and the like are used for convenience in explanation and understanding of the invention only, and are not intended to be, nor should they be considered as, used in any limiting sense.

DISCLOSURE OF THE INVENTION

According to an aspect of the invention, a combination includes a coating dispensing device for dispensing coating material. The device includes a hand grip. The combination further includes a grip cover for covering the hand grip. The grip cover includes material softer than the hand grip for cushioning a hand of an operator holding the device.

Illustratively according to this aspect of the invention, the grip cover defines an opening through which an operator holding the device can maintain contact with the hand grip.

Illustratively according to this aspect of the invention, the grip cover includes a shell for removably fitting over the hand grip. The material softer than the hand grip includes a pad coupled to an outer surface of the shell.

Illustratively according to this aspect of the invention, the pad is overmolded onto the shell.

Illustratively according to this aspect of the invention, the shell includes a bead and the hand grip includes a groove for receiving the bead.

Illustratively according to this aspect of the invention, the grip cover comprises a sleeve for placement around the hand grip.

Illustratively according to this aspect of the invention, the grip cover is textured.

Illustratively according to this aspect of the invention, the coating dispensing device is a manual spray gun.

Illustratively according to this aspect of the invention, the grip cover is overmolded onto the hand grip.

According to another aspect of the invention, a hand grip is provided for use with a coating dispensing device including a hand grip. The grip cover at least partially covers the hand grip. The grip cover includes material softer than the hand grip for cushioning a hand of an operator holding the device.

Illustratively according to these aspects of the invention, the material comprises elastomeric material.

Illustratively according to these aspects of the invention, the grip cover is electrically non-conductive.

Alternatively illustratively according to these aspects of the invention, the grip cover is electrically non-insulative.

According to another aspect of the invention, a grip cover is provided for use with a coating dispensing device including a hand grip. The grip cover includes a shell for fitting over the hand grip and a pad coupled to the shell. The pad includes material softer than the hand grip for cushioning a hand of an operator holding the device.

Illustratively according to this aspect of the invention, the cushioning material is ethylene propylene dieneter polymer (EPDM).

Illustratively according to this aspect of the invention, the pad is overmolded onto the shell.

Illustratively according to this aspect of the invention, each of the shell and the pad has a U-shaped cross-section for receiving within the U-shaped cross-section at least a portion of the hand grip.

BRIEF DESCRIPTION OF THE DRAWINGS

The invention may best be understood by referring to the following description and accompanying drawings which illustrate the invention. In the drawings.

DETAILED DESCRIPTIONS OF ILLUSTRATIVE EMBODIMENTS

Figure 1:
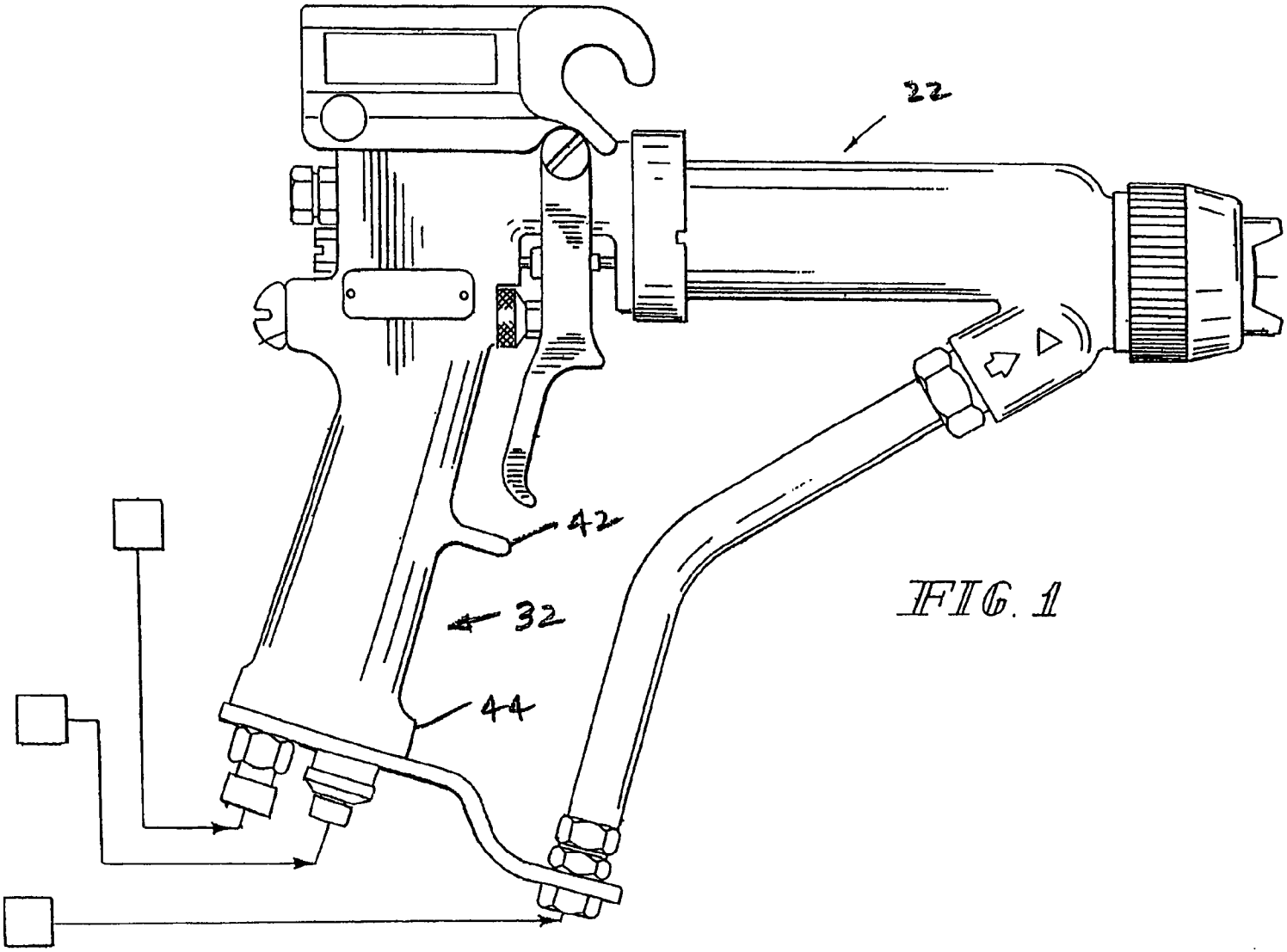
FIG. 1 illustrates a side elevational view of an atomizer of a type which is capable of incorporating the invention, with other components of a system incorporating the atomizer illustrated diagrammatically.
Figure 2:
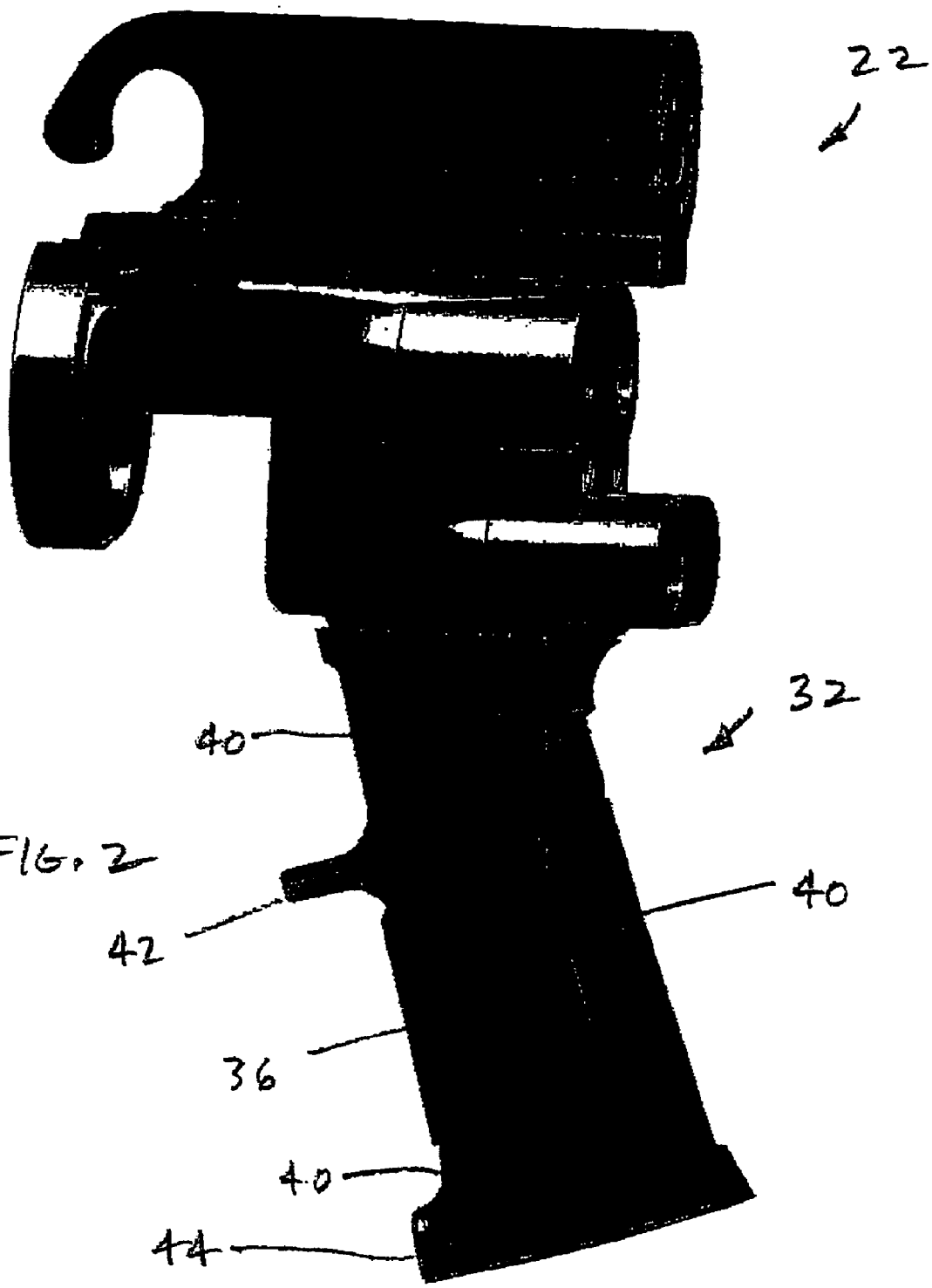
FIG. 2 illustrates a perspective view from one side and slightly from the rear, of a portion of an atomizer including a grip constructed according to the present invention.
Figure 3A:
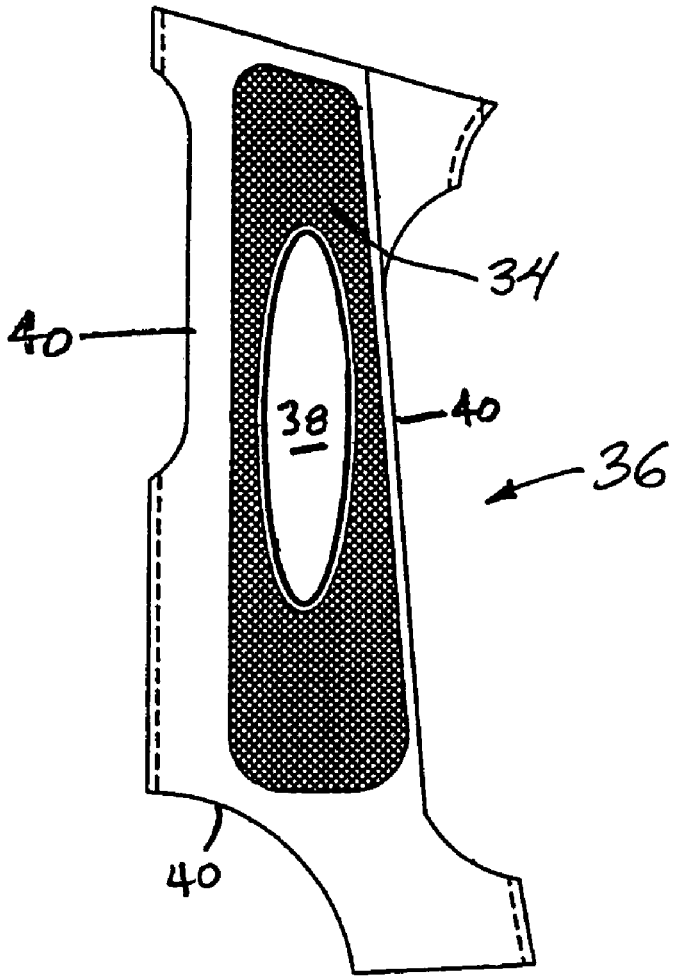
FIGS. 3*a–b* illustrate side elevational views of a grip cover according to the present invention.
Figure 4:
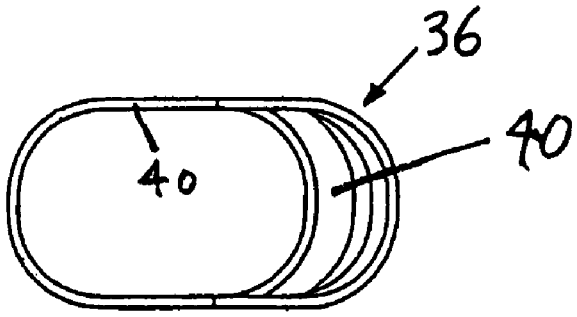
FIG. 4 illustrates a bottom plan view of a grip cover according to the present invention.
Figure 3B:
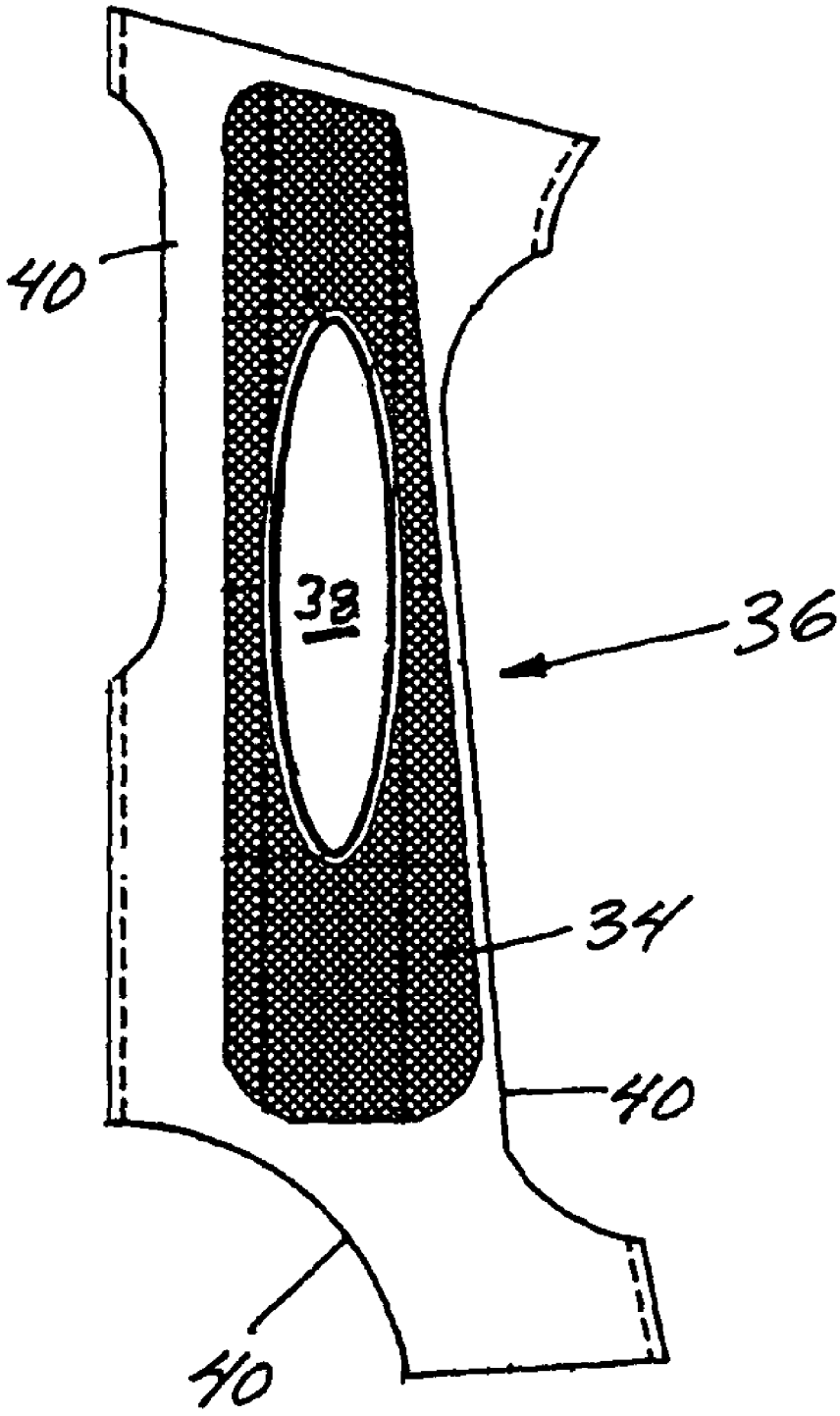
Figure 5:
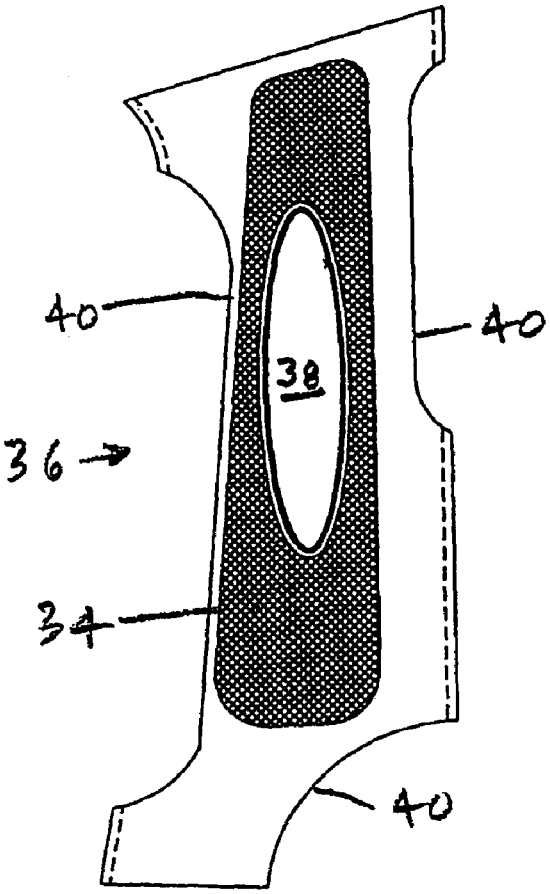
FIG. 5 illustrates a side elevational view of a grip cover according to the present invention, from the side opposite the side illustrated in FIGS. 3*a–b;*
Figure 6:
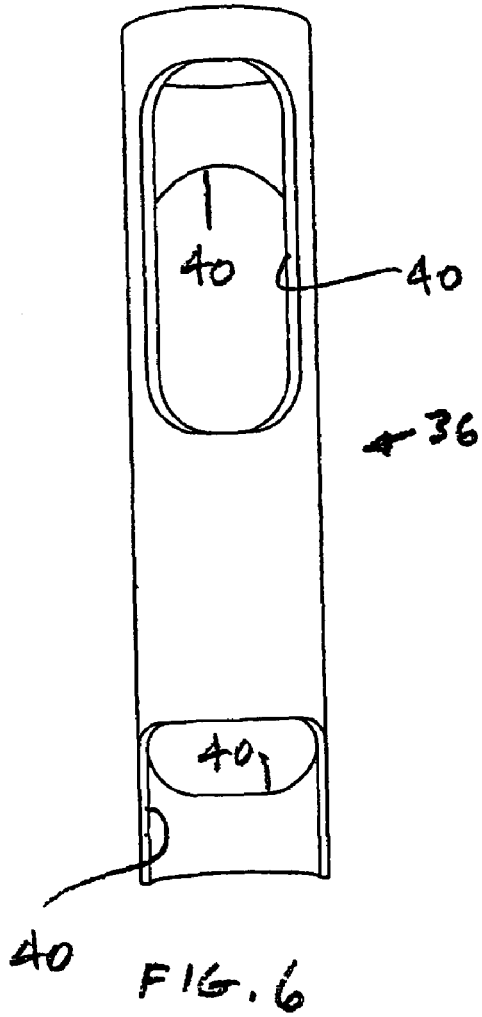
FIG. 6 illustrates a front elevational view of a grip cover according to the present invention.
Figure 7:
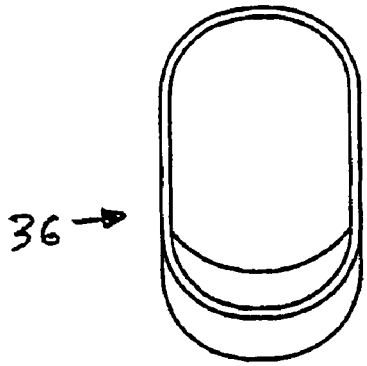
FIG. 7 illustrates a top plan view of a grip cover according to the present invention.
Figure 8:
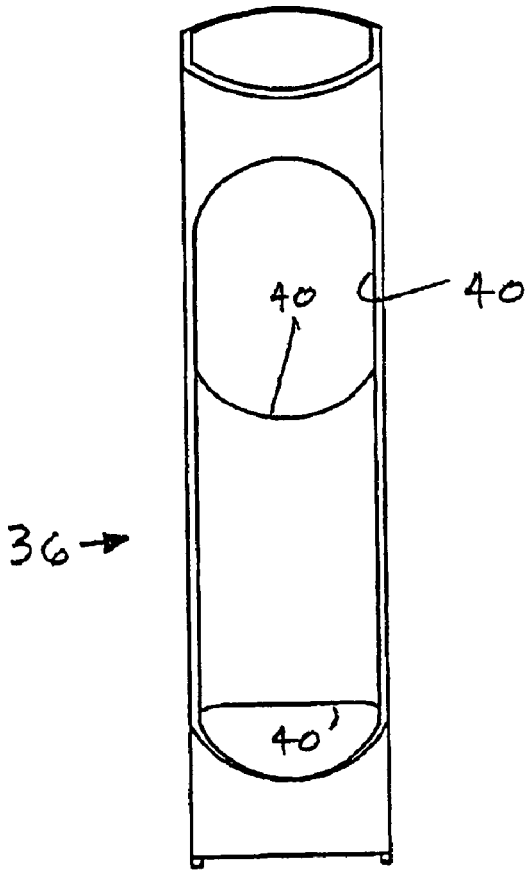
FIG. 8 illustrates a rear elevational view of a grip cover according to the present invention.
Figure 9:
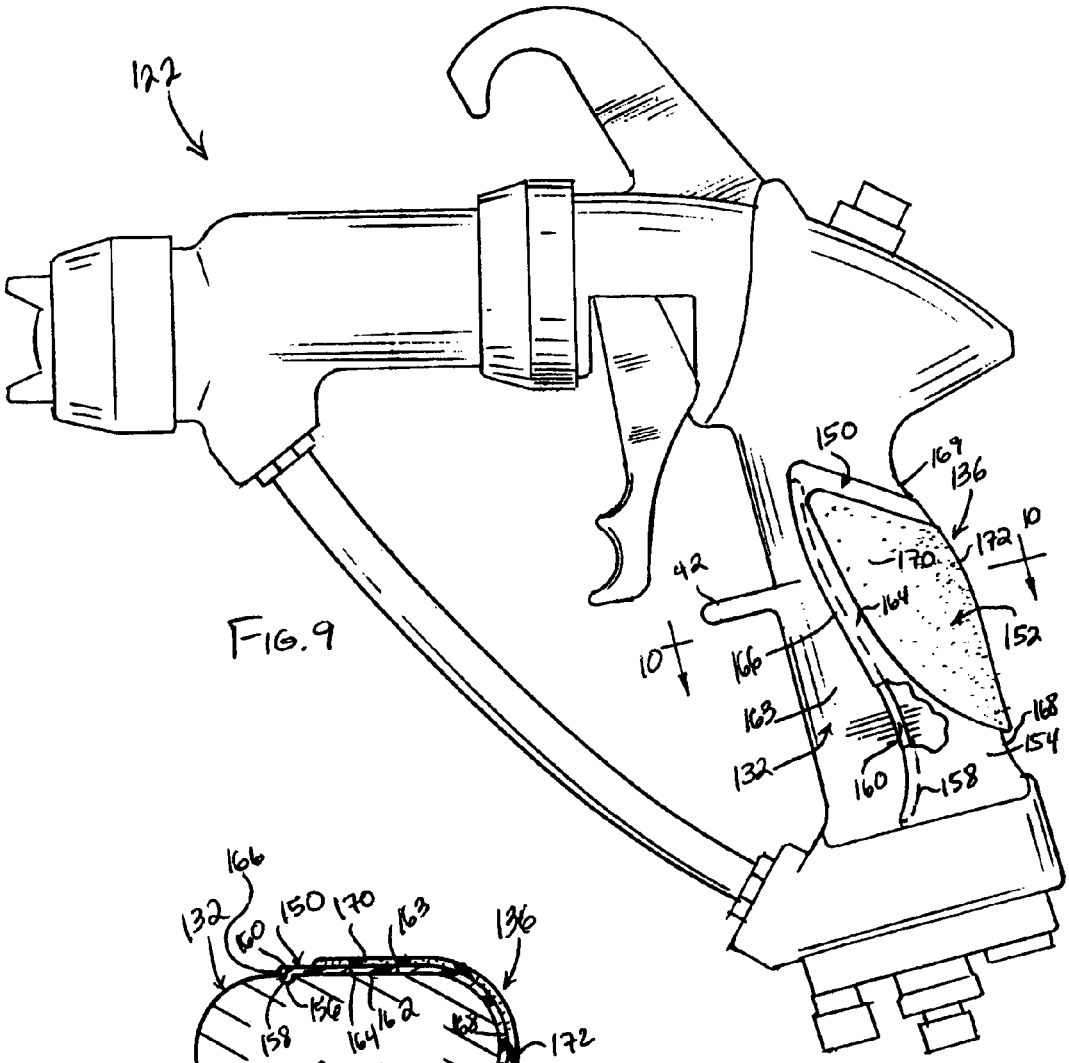
FIG. 9 illustrates a side elevational view of another atomizer of a type which is capable of incorporating the invention.

The device of the present invention is intended to fit over the pistol grip-type handle of a dispensing device (hereinafter sometimes "gun") 22 for dispensing, for example, a coating material. Gun 22 illustratively is of the general type of the Ransburg model REA 3, REA 4, REA 70, REA 90, REM and M-90 guns, available from ITW Ransburg, 320 Phillips Avenue, Toledo, Ohio, 43612-1493. The gun 22 is somewhat pistol shaped and includes a grip 32. The grips 32 of such guns 22 are typically constructed from, for example, filled or unfilled, abrasion—and dispensed material-resistant resins or metals such as aluminum. Because the material from which such a grip 32 is constructed is generally relatively hard, and the operator may use the gun 22 for extended periods of time, operator comfort is to be considered in the design of the gun 22.

In an effort to provide some additional comfort to an operator of such a gun 22, the gun 22 is constructed with (for example, by over molding), or is subsequently fitted with, a grip cover 36 which is constructed from a softer (for example, 45 Shore A hardness) material than grip 32. Grip cover 36 illustratively has a uniform thickness of 0.045 inch (about 1.1 mm). Grip cover 36 illustratively is constructed from material such as rubber, a rubber-like material such as ethylene propylene dieneter polymer (EPDM), or other elastomeric material. Grip cover 36 illustratively is configured as a sleeve surrounding grip 32.

The grip cover 36 may be knurled or otherwise textured, as indicated at 34. The grip cover 36 can also be constructed of a material having some color other than the color of the grip 32. The grip cover 36 can also provide a space, such as space 38 for, for example, a logo, gun 32 serial or model number or name, indicia of manufacture or ownership, or the like. The material from which the grip cover 36 is constructed can be electrically non-conductive or electrically non-insulative. If the operation of the gun 22 is electrostatically aided, grip 32 typically will be required to be grounded. The cover 36 of such a gun 22 will need to be provided with some mechanism, such as (a) slot(s) or (an) opening(s) 40 through which the operator maintains contact with the grip 32. This (these) opening(s) 40 can also be so located relative to the grip 32 to accommodate features, such as features 42, 44, of the grip 32.

Another grip cover 136 is illustrated in FIGS. 9–15. Grip cover 136 is provided for partially covering the pistol grip-type handle 132 of a gun 122 for dispensing coating material. Again, the gun 122 illustratively is a manual spray gun for dispensing coating material. The grip cover 136 includes material softer (again, for example, 45 Shore A hardness) than the relatively hard hand grip 132 for providing some cushioning of the hand of an operator using the gun 122.

The grip cover 136 illustratively includes a shell 150 that fits over the hand grip 132 and a pad 152 coupled to the shell 150 and constructed of the cushioning material. The pad 152 illustratively is coupled to an outer surface 154 of the shell 150, such as by overmolding. The shell 150 illustratively is constructed of nylon 12 with carbon fiber and is injection-molded. The pad cushioning material illustratively is rubber, a rubber-like material such as EPDM, or other elastomeric material. The thickness of each of the shell 150 and pad 152 illustratively is 0.045 inch (about 1.1 mm).

The grip cover 136 illustratively is configured to be slipped over and removed from the hand grip 132. The shell 150 has an opening 156 extending the length thereof for the hand grip 132 to pass therethrough during attachment of the grip cover 136 to the hand grip 132 or removal of the grip cover 136 therefrom.

There a variety of ways to couple the grip cover 136 to the hand grip 132. Illustratively, the shell 150 includes two elongated beads 158 that are provided on an inner surface 162 of the shell 150 and fit into corresponding elongated grooves 160 provided on opposite hand grip side walls 163 of the hand grip 132. Each bead 158 illustratively is coupled to the inner surface 162 of a generally straight side wall 164 along an outer edge 166 thereof. Connecting pins, threaded fasteners, or the like (not illustrated), may be employed instead of or in addition to the beads 158, to couple the outer shell 150 to the hand grip 132.

Figure 10:
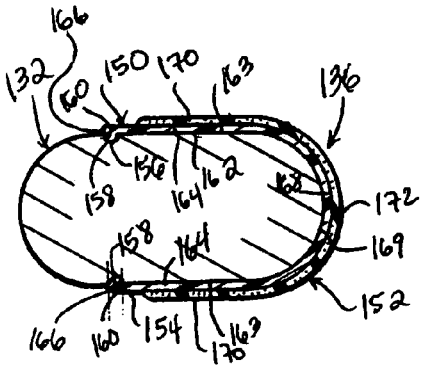
FIG. 10 illustrates a sectional view taken along section lines 10—10 of FIG. 9.
Figure 11:
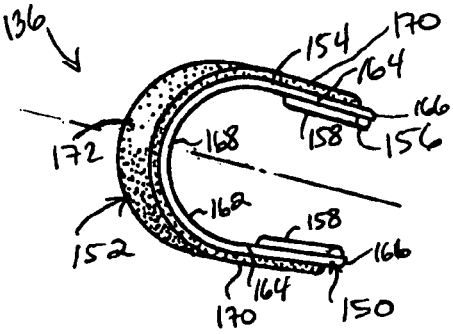
FIG. 11 illustrates a top plan view of a grip cover according to the present invention.
Figure 12:
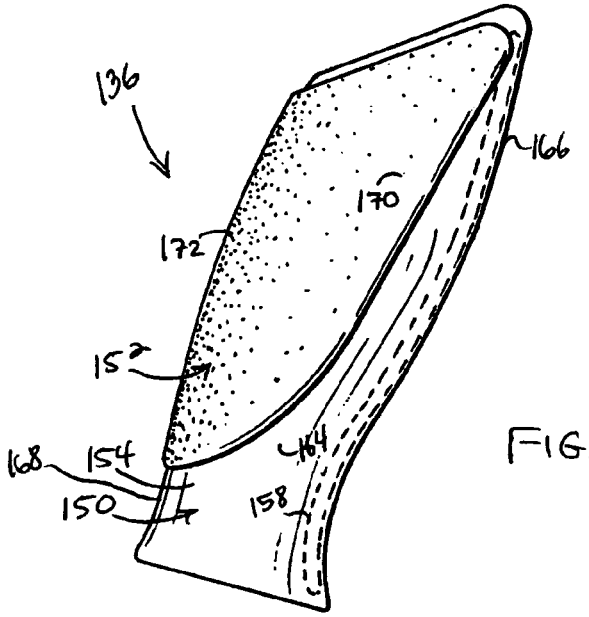
FIG. 12 illustrates a side elevational view of a grip cover from the side opposite the side illustrated in FIG. 9.
Figure 13:
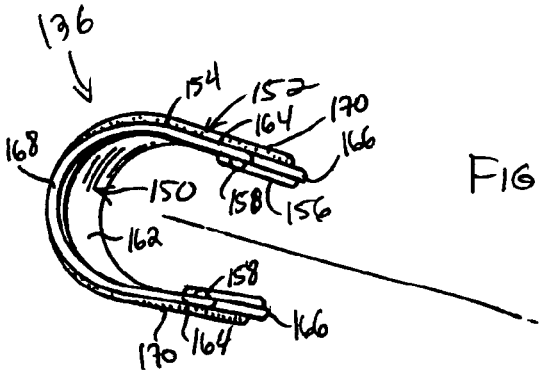
FIG. 13 illustrates a bottom plan view of a grip cover according to the present invention.
Figure 14:
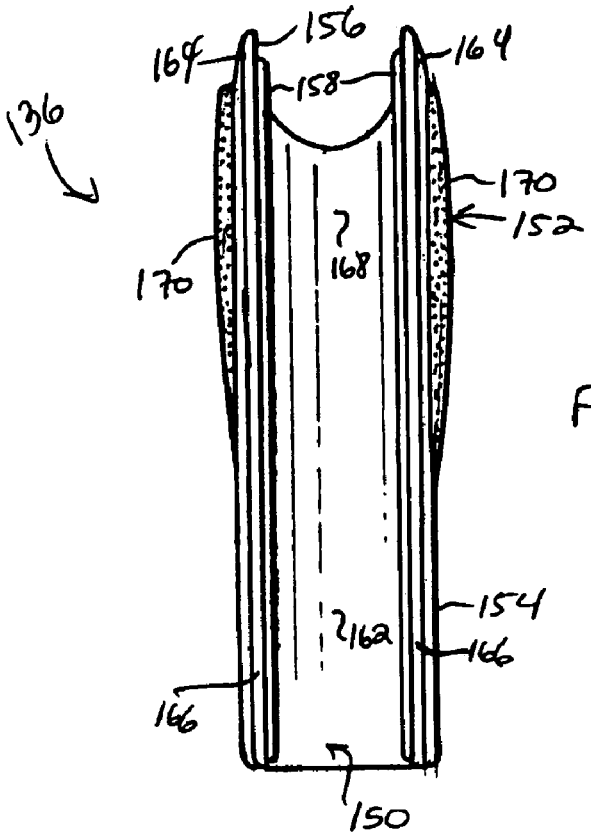
FIG. 14 illustrates a front elevational view of a grip cover according to the present invention; and, FIG. 15 illustrates a rear elevational view of a grip cover according to the present invention.
Figure 15:
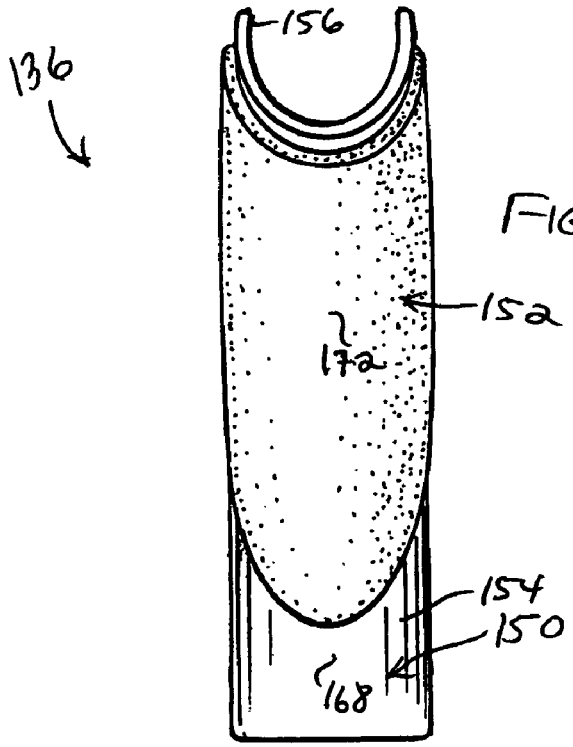

The grip cover 136 illustratively has a U-shaped cross-section illustrated in FIG. 10 to promote attachment of the grip cover to, and removal of the grip cover 136 from, the hand grip 132. The shell side walls 164 and a shell intermediate curved wall 168 interconnecting the shell side walls 164 provide the U-shaped cross-section of the shell 150. The shell side walls 164 cover the hand grip side walls 163 and the shell intermediate curved wall 168 covers a hand grip rear wall 169. A pair of spaced-apart, generally straight pad side walls 170 and a pad intermediate curved wall 172 interconnecting the pad side walls 170 provides the U-shaped cross-section of the pad 152. Each pad side wall 170 covers a shell side wall 164 and the pad intermediate curved wall 172 covers the shell intermediate curved wall 168. Shell 150 may be constructed so that side walls 164 extend from curved wall 168 generally toward each other at an included angle of, for example, 10°. In this way, if the shell 150 is constructed from (a) resilient material(s), it may be deformed slightly and snapped onto hand grip 132. This can aid in maintaining grip cover 136 on hand grip 132 during use of the gun 122.

The shell 150 and pad 152 may be constructed from, for example, graphite or other conductive material-filled resins to render them electrically non-insulative to promote grounding of an operator of the gun 122 through the shell 150 and pad 152. Alternatively, the shell 150 and pad 152 may be formed from materials to be electrically non-conductive. In such a case, a gun operator may contact the gun 122 through opening 156 to promote operator grounding.

Although the invention has been described in detail with reference to certain embodiments, variations and modifications exist within the scope and spirit of the invention as described and defined in the following claims.

What is claimed is:

1. In combination, a coating dispensing device for dispensing coating, the device including a hand grip, and a grip cover for covering the hand grip, the grip cover including material softer than the hand grip, the grip cover including a shell for removably fitting over the hand grip, the material softer than the hand grip including a pad coupled to an outer surface of the shell, one of the shell and hand grip including a bead and the other of the shell and hand grip including a groove for receiving the bead.

2. The combination of claim 1 wherein the material comprises elastomeric material.

3. The combination of claim 1 wherein the grip cover is electrically non-conductive.

4. The combination of claim 1 wherein the grip cover is electrically non-insulative.

5. The combination of claim 1 wherein the grip cover defines an opening through which an operator holding the device can maintain contact with the hand grip.

6. The grip cover of claim 1 wherein the pad is overmolded onto the shell.

7. The combination of claim 1 wherein the grip cover comprises a sleeve for placement around the hand grip.

8. The combination of claim 1 wherein the grip cover is textured.

9. The combination of claim 1 wherein the coating dispensing device is a manual spray gun.

10. The combination of claim 1 wherein the grip cover is overmolded onto the hand grip.

11. For use with a coating dispensing device including a hand grip, a grip cover for at least partially covering the hand grip, the grip cover including material softer than the hand grip, the grip cover including a shell for removably fitting over the hand grip, the material softer than the hand grip including a pad coupled to an outer surface of the shell, one of the shell and hand grip including a bead and the other of the shell and hand grip including a groove for receiving the bead.

12. The combination of claim 11 wherein the material comprises elastomeric material.

13. The combination of claim 11 wherein the grip cover is electrically non-conductive.

14. The combination of claim 11 wherein the grip cover is electrically non-insulative.

15. For use with a coating dispensing device including a hand grip, a grip cover including a shell for fitting over the hand grip and a pad coupled to the shell, the pad including ethylene propylene dieneter polymer softer than the hand grip.

16. The grip cover of claim 15 wherein the pad is overmolded onto the shell.

17. The grip cover of claim 15 wherein each of the shell and the pad has a U-shaped cross-section for receiving within the U-shaped cross-section at least a portion of the hand grip.

* * * * *